United States Patent [19]

Blackburne

[11] 3,995,743

[45] Dec. 7, 1976

[54] ACCESSORIES FOR TOOTH BRUSHES

[76] Inventor: Robin Michael Blackburne, Ardsheal Cottage, Paget 6-20, Bermuda

[22] Filed: Feb. 25, 1975

[21] Appl. No.: 552,965

[30] Foreign Application Priority Data

Mar. 5, 1974 United Kingdom ..... 9916/74

[52] U.S. Cl. ..... 211/65; 15/184; 206/362.3; 248/110

[51] Int. Cl.[2] ..... A47B 81/02; A46B 17/04

[58] Field of Search ..... 15/184, 185, 167 R, 15/167 A; 206/362.1–362.3; 248/110–113; 211/65

[56] References Cited

UNITED STATES PATENTS

| | | | |
|---|---|---|---|
| 1,266,382 | 5/1918 | Bailey et al. | 206/361.3 |
| 1,653,540 | 12/1927 | Bigoney | 206/362.3 |
| 2,797,886 | 7/1957 | Pinckney | 15/184 |
| 2,897,531 | 8/1959 | Calabrese | 15/184 |
| 2,947,412 | 8/1960 | Tupper | 206/362.3 |
| 3,120,019 | 2/1964 | Scott | 15/184 |

*Primary Examiner*—Peter Feldman
*Attorney, Agent, or Firm*—Brisebois & Kruger

[57] ABSTRACT

This invention relates to an accessory for a tooth brush, which is intended to be attached to the head of the tooth brush when not in use, so as to cooperate with the bristles to deflect them towards each other from a splayed-apart condition. In one embodiment, the accessory is formed from a plastics material, and includes a channel member defining a longitudinally extending channel dimensioned to receive at least the bristles of the tooth brush head. The inner side surfaces of the channel, which may be convergent, cooperate with at least the regions of the bristles adjacent the tips thereof to press them together.

7 Claims, 2 Drawing Figures

ACCESSORIES FOR TOOTH BRUSHES

The present invention relates to accessories for brushes, and in particular for tooth brushes.

A tooth brush generally comprises a handle, and a head including a rigid base connected to, for example, integral with, the handle. Carried by this base is a plurality of upstanding natural or synthetic bristles or the like. As is well known, although the bristles are usually approximately mutually parallel, and perpendicular to the base of the tooth brush head, when the tooth brush is new and unused, the bristles become permanently deformed, and in particular splay apart, after repeated use of the tooth brush. It is this deformation, rather than actual wear of the bristles, which limits the useful life of a tooth brush.

It is an object of the present invention to provide an accessory which reduces this undesirable deformation of the bristles, and thus prolongs the useful life of the tooth brush.

According to the present invention, there is provided a device for attachment to the head of a brush, including means operable to releasably retain the device attached to the head of a brush when the brush is not in we, and means cooperable with the bristles of the brush head, when the device is attached to the brush head, to deflect the bristles towards each other.

The invention also consists in a brush, particularly a tooth brush, in combination with a device as just defined.

It is to be understood that the term "bristles" used in the specification and appended claims encompasses natural and/or synthetic bristles, fibres or other elongate elements, as well as resilient pads or other means operable to fulfill the same function.

Although the bristles of a brush such as a tooth brush may become splayed apart laterally of the head of the tooth brush, the device, which is attached to the head of the tooth brush during periods of non-use, presses and deflects the bristles laterally back towards or beyond their original generally upright position, and retains them in this deflected state. Thus, when the tooth brush is to be used again, and the device is removed, the bristles will have taken up a set approaching that assumed by the bristles in the new and unused condition of the tooth brush.

The device may be simply slipped longitudinally onto, or sprung over, the head of the tooth brush, so as to be carried by, and form a cover for the head. Alternatively, one or more such devices may be incorporated in a tooth brush holder or rack, for example, a wall-mounted holder, from which one or more tooth brushes are suspended by their heads when not in use, or are suspended by the bristles themselves due to the frictional grip thereof by the portions of the holder which cooperate with the bristles.

In order that the invention may be more readily understood, reference will now be made to the accompanying drawings, in which.

Figure 1:
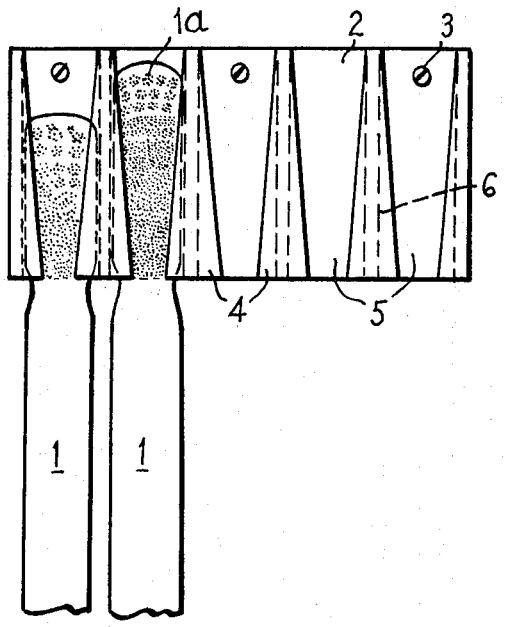
FIG. 1 is a front view of a wall-mounted toothbrush rack or holder embodying the present invention.

Referring to FIG. 1, there is shown a rack or holder designed to hold up to five tooth brushes, two of which are shown at 1. The holder includes a back plate 2 provided with apertures to receive screws 3 by which the holder is secured to a wall or other generally vertical surface (not shown).

Carried by and spaced from the back plate are six longitudinally extending guides 4 which define five longitudinally extending channels 5 therebetween. In the operative position of the holder as shown, the longitudinal axes of the guides 4 and channels 5 are disposed vertically, and the guides 4, which are of generally inverted V- shape, increase in width towards their lower ends, so that the channels 5 are correspondingly downwardly convergent. Each channel may, for example, be approximately ½ inch wide at its upper end, and ¼ inch wide or less at its lower end. Thus, each channel 5 converges downwardly from a width approximating the transverse width of the base of the head of a conventional tooth brush, to a width which is significantly less than that of the base of the head, and also less than the width of the rows of bristles at their roots where they emerge from the base of the head.

Where the guides 4 are connected to the back plate 2 they are relieved or undercut to form longitudinally extending recesses which define, for example, ribs 6 as shown in broken lines. The separation between adjacent ribs is slightly greater than the transverse width of the handle and the base of the head part of the tooth brush 1, and the extent or height of the ribs in a direction perpendicular to the plane of the back plate 2 is greater than the thickness of the toothbrush handle and base of the head, but less than the thickness of the base plus the length of the natural or synthetic bristles 1*a* carried by the base of the head. The extent or height of the guides 4, in a direction perpendicular to the plane of the back plate 2, approximates, or may be slightly greater than, the length of the bristles 1*a*.

It will be appreciated that each channel 5, as viewed in cross-section, i.e. in a plane perpendicular to the back plate 2, is generally "U" shaped, with the inner surface of the back plate defining the base limb of the U. The recesses defining the ribs 6 constitute first longitudinally extending zones intended to accommodate the base of the tooth brush head, and the opposed side surfaces of the adjacent guides 4 which are separated from the back plate 2 by the ribs 6 constitute second longitudinally extending zones intended to accommodate the bristles of the tooth brush head.

In use of the wall-mounted holder of FIG. 1, after a tooth brush has been used, it is inserted, handle downwards into one of the convergent channels, with the handle and base of the head of the tooth brush adjacent the back plate, located by and within the relieved or undercut portion defined by ribs 6, and with the bristles away from the back plate.

As the tooth brush is drawn longitudinally downwardly by its handle, and the head slides down between the guides 4, the bristles 1*a* are progressively pressed towards each other by the convergent, generally flat side surfaces of the guides 4, transversely of the head, to the position shown in which the head is at or adjacent the lower end of its associated channel 5. In this position, the bristles 1*a* are deflected towards each other to such an extent that they are, at least at their tips, closer together than in the new or unused condition of the tooth brush. The handle is then released, and the frictional grip between the deflected bristles 1*a* and guides 4, serves to positively retain the tooth brush suspended in this position.

It will thus be apparent that the side surfaces of the guides 4 serve both as retaining means and bristle deflecting means for the tooth brush. The recesses defining the ribs 6, togther with the back plate 2, cooperate with the base of the tooth brush head, and as well as guiding the head, serve to positively retain the head by preventing separation thereof from the channel 5 in a direction towards the open side of the channel, i.e. in a direction normal to, and away from, the back plate 2.

The brush is left suspended in the previously mentioned position, with its bristles pressed together, until it is to be used again, at which time the toothbrush is simply withdrawn downwardly from the channel 5 by grasping the handle. Alternatively the tooth brush could be pushed upwardly out of the channel 5. When released, the bristles 1*a* are no longer restrained by the guides 4, and due to their inherent natural resilience, will tend to splay out to a small degree. However, since the bristles, prior to release from the holder, have been pressed inwardly to a position beyond that which they occupied in their new or unused condition, and since they will usually have been retained in this position for a substantial period of time and whilst they are drying out, they will not return to the splayed out position to which they were deformed by previous use, but will take up some intermediate set approximating to the position which they occupied when in their new or unused condition.

Thus, one or more tooth brushes may be held in the holder during their periods of non-use, and while being held, their bristles will be pressed or deflected back towards or beyond their new or unused position, substantially reducing or eliminating any splay deformation imparted thereto as a result of previous use.

Figure 2:
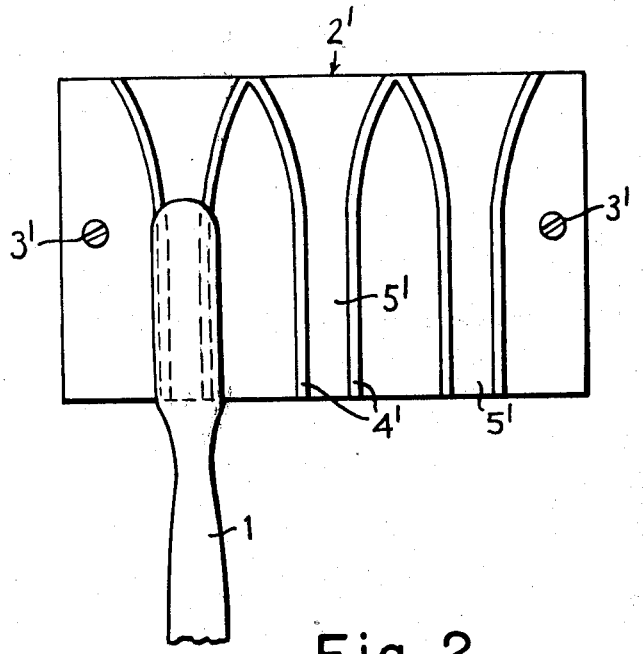
FIG. 2 is a front view of a further embodiment of a wall-mounted holder, similar to that of FIG. 1.

A particulary effective and advantageous alternative to the holder of FIG. 1 is shown in FIG. 2, In this embodiment, which is simpler to produce, the undercut portions defined by the ribs 6 in FIG. 1 are omitted. The holder of FIG. 2 includes a plurality, for example three, pairs of longitudinally extending guides 4' which define three longitudinally extending channels 5'. The guides 4' are moulded, from a suitable synthetic plastics material, integrally with the back plate 2', and the guides 4' of each pair describe , with respect to each other, a gentle convex curve along their length, and mutually converge from their upper towards their lower ends. Towards their lower ends, the curvature of the guides 4' may decrease, and the guides may become straighter and more mutually parallel, at a mutual spacing satisfactorily less than the normal narrowest known tooth brush bristle configurations.

In this construction, the tooth brush 1 is fitted to the holder with the tips of the bristles directed towards the back plate and the base and handle spaced from the back plate by the guides 4'. The brush is merely slid from the outside down between the guides 4, until the friction upon the bristles becomes great enough to retain the brush in the position shown.

The holders shown in FIGS. 1 and 2 may be formed from any suitable material, for example moulded in one piece from a synthetic plastics material, such as a resilient synthetic plastics sheet material, or formed from wood, or metal such as a sheet metal, for example plated or coated steel.

It will be understood that various modifications may be made without departing from the scope of the present invention as defined in the appended claims. For example, although primarily intended to be used with tooth brushes, the devices may be arranged and adapted for use with other types of brushes. Although each of the devices shown is preferably designed to accommodate a variety of conventional tooth brushes of different shape and sizes, they could alternatively be specifically designed to accept one particular type of tooth brush alone.

The holders shown in FIGS. 1 and 2 may have any required number of tooth brush-receiving channels 5 to suit different size families, for example from two to six channels. The holders may be fixed to a wall or other surface by means other than screws, for example by one or more suction devices or cups, magnetic devices, hooks, eyes, or "Velcro" type fasteners. Alternatively, an adhesive may be employed, or the holder may be slidably cooperable with a fixed mounting on the wall or other surface.

Alternatively the holders could be portable instead of wall-mounted, and could then be used by travellers, in which event, they could be rested on a suitable surface when required, for example on a horizontal shelf or sill in a bathroom. In this case, the brushes will be slid along between the guides, and remain retained by friction, in a generally horizontal plane. Alternatively, the holders could be designed to stand in an upright position, oriented as shown in FIGS. 1 and 2 in which event, with the brushes disposed head-down, the brush heads would be inserted vertically downwardly between the guides.

Although not shown in FIGS. 1 or 2, the guides or the sides of the guides, could have small holes or be otherwise rendered porous to allow the passage of air and therefore more rapid drying of the bristles.

The guides 4 in FIG. 1 need not necessarily be wedge shaped, but could describe a gentle convex curve facing towards the bristles, for example as shown in FIG. 2. Alternatively the guides 4' of FIG. 2 could be wedged shaped as shown in FIG. 1.

I claim:

1. A combined hanger and bristle press device for a tooth brush which is releasably attachable to the head of a brush when the brush is not in use, and when attached, is cooperable with the bristles of the brush head to deflect the bristles towards each other, the device including a substantially rigid channel member defining a longitudinally extending channel dimensioned to receive at least the bristles of the brush head, the channel being longer than the bristle-containing zone of the head, being open at its opposite ends to permit insertion of at least the bristles of the head through one of said opposite ends into the channel in the longitudinal direction of the channel, and being generally U shaped in cross section, with the base limb and side limbs of the U being defined by generally longitudinally extending inner surfaces of a base member and a pair of opposed side members of the channel member, respectively, at least portions of the opposed inner surfaces of the side members being operable, when the device is attached to the head, to deflect the bristles towards each other and to releasably retain the device attached to the head, with the frictional grip between the said portions of the opposed inner surfaces and the bristles being sufficient to enable the brush to be suspended from the device without unintentional release therefrom, the opposed inner surfaces mutually converging from, and in a direction away from, said one opposite end of the channel, over a substantial portion of the length of the channel.

2. A tooth brush rack including a plurality of devices as claimed in claim 1, mounted side-by-side, with their channel members generally mutually parallel, and interconnected by a common base member, the channel members and base member being formed as a rigid one-piece moulding from a synthetic plastics material.

3. A rack as claimed in claim 2, wherein the intermediate side members of each pair of adjacent channel members are integrated into a single member, and wherein the opposed inner surfaces of the side members of the channel member are generally perpendicular to the inner surface of the base member, the base member being attachable to a generally upright support surface.

4. A rack as claimed in claim 3, wherein the opposed inner surfaces of the side members of each channel member mutually converged along substantially their entire length.

5. A rack as claimed in claim 3, wherein the opposed inner surfaces of the side members of each channel are relieved adjacent the inner surface of the base member, to form opposed generally longitudinally extending recesses which longitudinally slidably receive the base of the head with the bristles thereof extending away from the base member between the opposed inner surfaces of the side members.

6. A rack as claimed in claim 5, wherein the side members of each channel member are curved along at least a part of their length, towards the longitudinal end of the associated channel member into which the tooth brush head is intended to be inserted.

7. A rack as claimed in claim 6, wherein the opposed inner surfaces of the side members comprise the bristle-deflecting means, and also form the entire retaining means.

* * * * *